US005361468A

United States Patent [19]

Ho

[11] Patent Number: 5,361,468

[45] Date of Patent: Nov. 8, 1994

[54] SYSTEM FOR AUTOMATICALLY RIPPLING AND HACKLING WIG YARNS

[76] Inventor: Kim K. Ho, 3-623 Mia Dong, Dobong Ku, Seoul, Rep. of Korea

[21] Appl. No.: 81,819

[22] Filed: Jun. 22, 1993

[51] Int. Cl.[5] ..... D02G 1/14

[52] U.S. Cl. ..... 28/279; 28/220; 28/278; 19/115 R

[58] Field of Search ..... 19/66 R, 66 CR, 66.1, 19/66.2, 220, 115 R; 28/219, 220, 247, 249, 258, 262, 277, 278, 279, 280, 281

[56] References Cited

U.S. PATENT DOCUMENTS

| | | | |
|---|---|---|---|
| 217,325 | 1/1883 | Fletcher | 19/115 R |
| 3,140,525 | 7/1964 | Lamb | 28/279 |
| 4,979,274 | 12/1990 | McCullough, Jr. | 28/280 |
| 5,265,314 | 11/1993 | Enderlin | 28/278 |

*Primary Examiner*—Clifford D. Crowder
*Assistant Examiner*—Larry D. Worrell, Jr.
*Attorney, Agent, or Firm*—Harrison & Egbert

[57] ABSTRACT

A system for automatically rippling and hackling wig yarns. The system comprises a rippling heater having a pair of wave rollers each having a waveformed surface and a heating coil, a cooler having a cooling belt and a blast unit comprising a blast fan, a blast pipe and a blast diffuser, a hackling device for hackling the wig yarns from the cooler, a pair of tension rollers arranged between the cooler and the hackling device, and a plurality of pulling rollers having different diameters. The hackling device comprises a plurality of hackling units and/or a plurality of hackling conveyors. The hackling unit includes hackle bar driven by a drive unit, the hackle bar having a plate provided with a plurality of erected hackle pins and vertically reciprocating by the rotational force of the drive unit. The hackling conveyor includes a pair of belt pulleys and an endless hackle belt wrapping about the belt pulleys and having a plurality of erected hackle pins, the hackle belt moving in a direction opposite to a feeding direction of the wig yarns.

4 Claims, 5 Drawing Sheets

SYSTEM FOR AUTOMATICALLY RIPPLING AND HACKLING WIG YARNS

BACKGROUND OF THE INVENTION

1. Field of the Invention

The present invention relates in general to a wig preparation, and more particularly to rippling and hackling of the wig yarns carried out for raising the yarns and arranging the dishevelled rippled yarns neatly.

2. Description of the Prior Art

As well known to those skilled in the art, the wigs are painstaking handiworks requiring many hands, so that the wig industry has been prevalent generally in less advanced nations because of the lower personnel expenses of those nations. In the conventional wig preparation, a hackling process, in which the dishevelled wig yarns are hackled so as to be arranged neatly and to facilitate the wig preparation, requires many hands. As such, the personnel expenses thereof form the majority of the total personnel expenses of the wig preparation. In this regard, it has been desired an automatic machine for hackling the wig yarns, so to speak an auto-hackle machine.

However, the conventional wig yarns are limited in the tensile strength as well as the bending strength and this may cause yarn break, so that there is a difficulty in automation of the hackling process using a power machine. In addition, the wig industry has been regarded as a backward industry as described above and, in this regard, it lost favor with advanced nations, thus having an organic problem in its automation.

In the conventional hackling of the wig yarns, a small quantity of wig yarns are placed on conventional hackling means, such as a comb or a hackle bar provided with a great number of pins driven in a plate, and manually repeatedly pulled until the entangled yarns are raised and arranged neatly. Thus, such a conventional hackling manually requires manpower consumption, thereby deteriorating the productivity.

There has been proposed, as disclosed in Korean Utility Model Application Nos. 75-561 and 76-1411, a process for rippling synthetic hairs which is suitable for raising a small quantity of hairs as if the resultant wig was fabricated of a large quantity of hairs, thereby preparing a light wig which completely covers the bald-headed skin and hairs of the wearer. In this rippling process, the synthetic hairs pass through a set of heating compression rollers, engaging with each other and each having thereon a waveform tooth, so as to be rippled.

However, this process contributes to the automation of the rippling but has no concern with the hackling of the wig yarns, thereby contributing in no way to the automation of the hackling of the wig yarns.

SUMMARY OF THE INVENTION

It is, therefore, an object of the present invention to provide a system for automatically rippling and hackling the wig yarns in which the above problems can be overcome and which automatically continuously ripples and hackles the wig yarns.

To accomplish the above object, a system for automatically rippling and hackling wig yarns according to an embodiment of the present invention comprises a rippling heater having a pair of wave rollers each having a waveformed surface and a heating coil; a cooler having a cooling belt and a pneumatic unit comprising a blast fan, a blast pipe and a blast diffuser; a plurality of hackling units each including a hackle bar driven by a drive unit, the hackle bar having a plate provided with a plurality of erect hackle pins and vertically reciprocating by the rotational force of the drive unit; a pair of tension rollers arranged between the cooler and the hackling device, and a plurality of pulling rollers having different diameters.

In another embodiment of the present invention, the hackling units are substituted with a plurality of hackling conveyors each including a pair of belt pulleys and an endless hackle belt wrapping about the belt pulleys and having a plurality of erect hackle pins, the hackle belt moving in a direction opposite to a feeding direction of the wig yarns.

In still another embodiment of the present invention, both the hackling units and the hackling conveyors are provided for the system to hackle the wig yarns.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
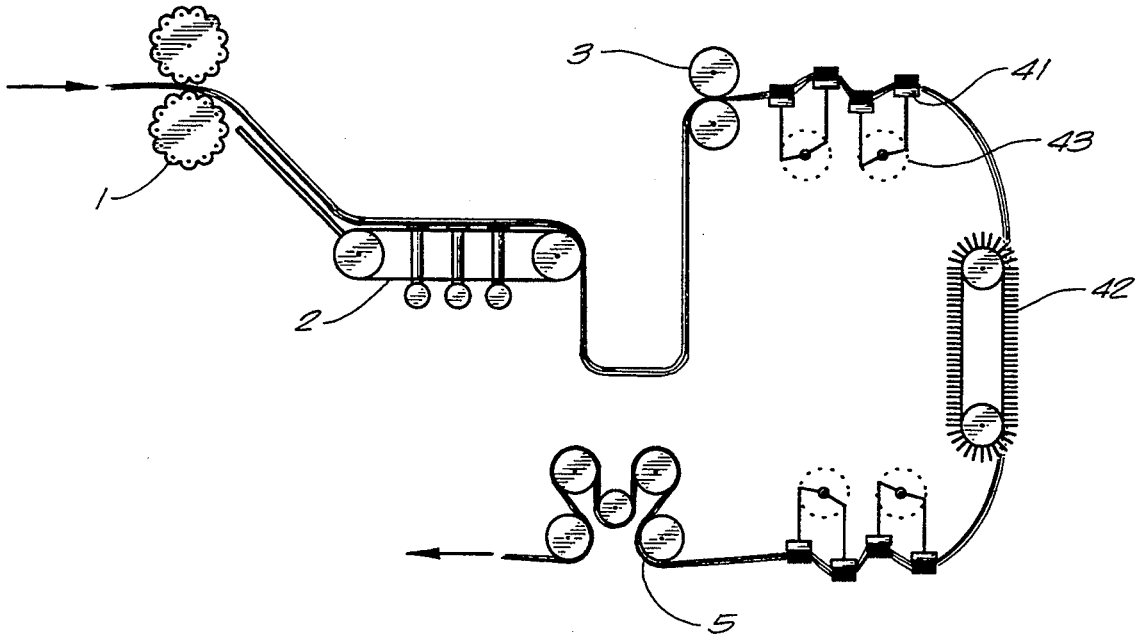
FIG. 1 is a systematic view showing the rippling and hackling process carried out by a rippling and hackling system in accordance with the present invention.

With reference to FIG. 1, there is shown in a systematic diagram an automatic rippling and hackling process carried out by a rippling and hackling system in accordance with an embodiment of the present invention. In operation of the rippling and hackling system, the wig yarns, supplied in a bundle or separately from respective bobbins, are fed to a rippling heater 1, comprising a pair of wave rollers 11, prior to reaching a cooler 2. The wig yarns from the cooler 2 are, thereafter, fed to a hackling device 4 by way of tension rollers 3 and passes through a pulling roller device 5 comprising a plurality of rollers 5, thereby achieving the rippling and hackling.

Figure 2:
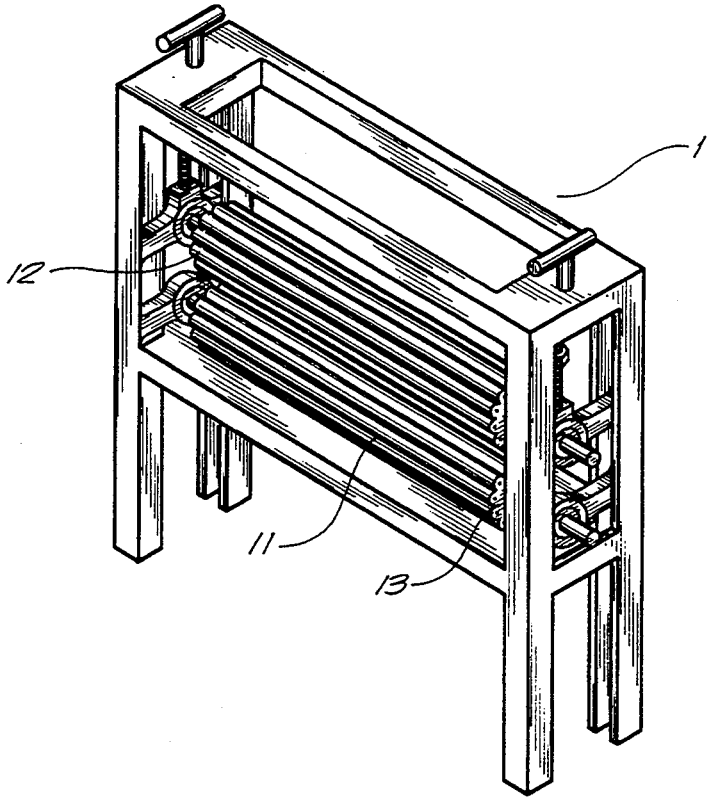
FIG. 2 is a perspective view of a rippling heater of the rippling and hackling system of the present invention.

Turning to FIG. 2, there is shown an embodiment of the rippling heater 1 of the present invention. The rippling heater 1 comprises the pair of wave rollers 11 having respective waveformed surfaces and gearing with each other. Each of the rounded axial teeth 12 of the roller surface has a pitch ranging from 1 mm to 30 mm and a tooth height ranging from 1 mm to 30 mm. In addition, each of the wave rollers 11 is provided therein with a heating coil 13 and a thermocouple, so that it is controlled in its inner temperature such that its waveformed surface is heated to temperature ranging from 80° C. to 200° C., preferably ranging from 80° C. to 100° C.

Figure 3A:
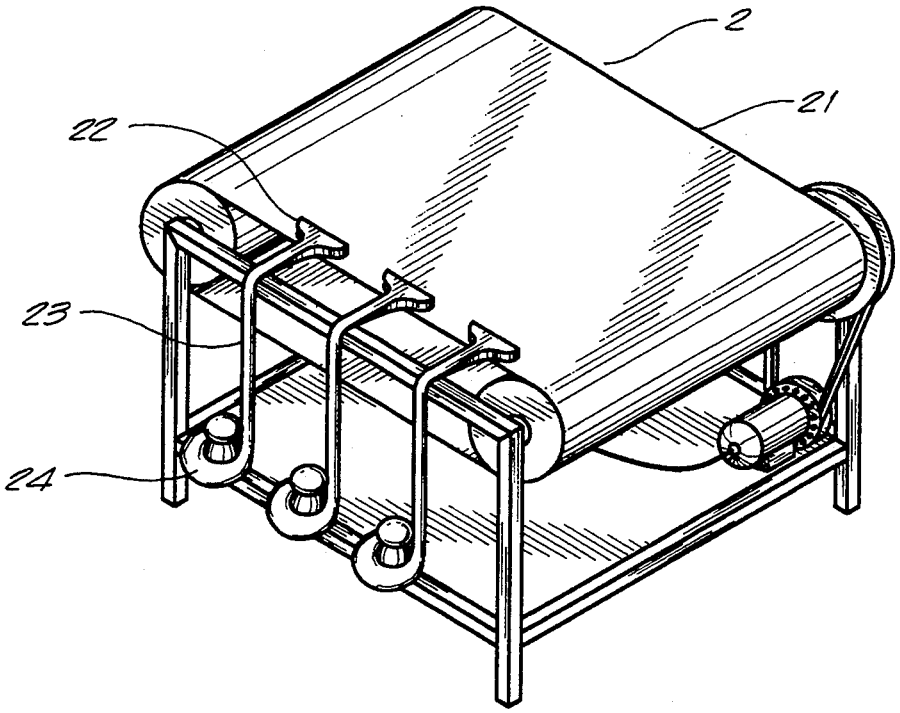
FIGS. 3A and 3B are perspective views of different embodiments of a cooler of the rippling and hackling system of the present invention, respectively.
Figure 3B:
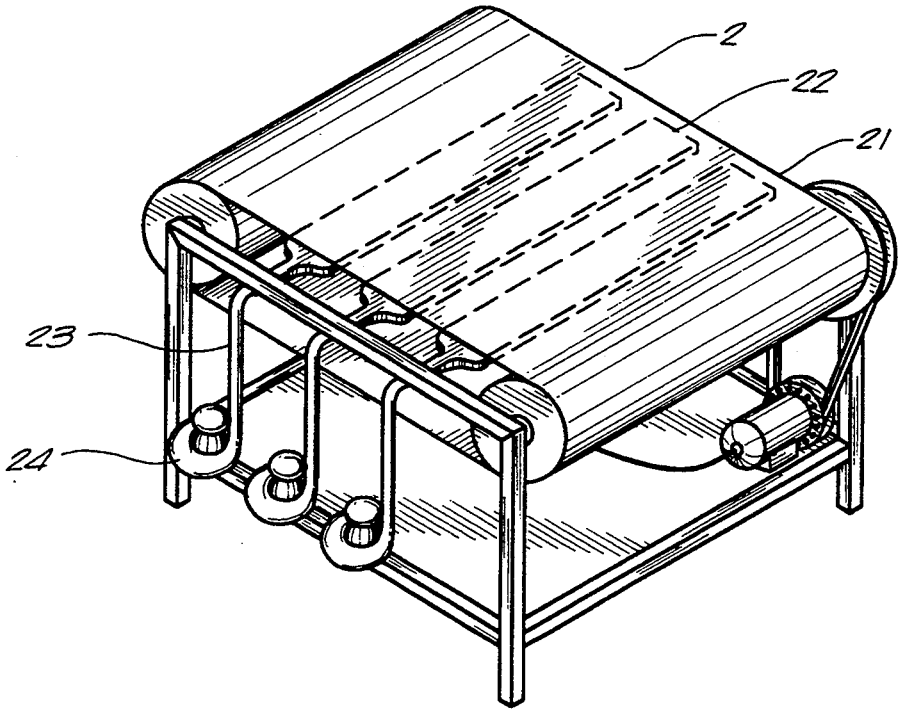

FIGS. 3A and 3B show different embodiments of a cooler 2 of the rippling and hackling system of the present invention. This cooler 2 is adapted for cooling the rippled and heated wig yarns to a predetermined temperature. In the primary embodiment of FIG. 3A, the cooler comprises a motor driven cooling belt 21 and a plurality of pneumatic units. Each of the pneumatic units comprises a pneumatic diffuser 22 positioned above the cooling belt 21. The pneumatic diffuser 22 in turn communicates with a pneumatic fan 24 through a pneumatic pipe 23.

In the second alternate embodiment of FIG. 3B, the general shape of the cooler remains the same as in the primary embodiment of FIG. 3A, but the position of the pneumatic diffusers 22 and the material of the cooling belt 21 are altered. That is, in the second alternate embodiment, the cooling belt 21 is fabricated from a gauze and the pneumatic diffusers 22 each having a rectangular output are positioned under the gauze belt 21.

Figure 4A:
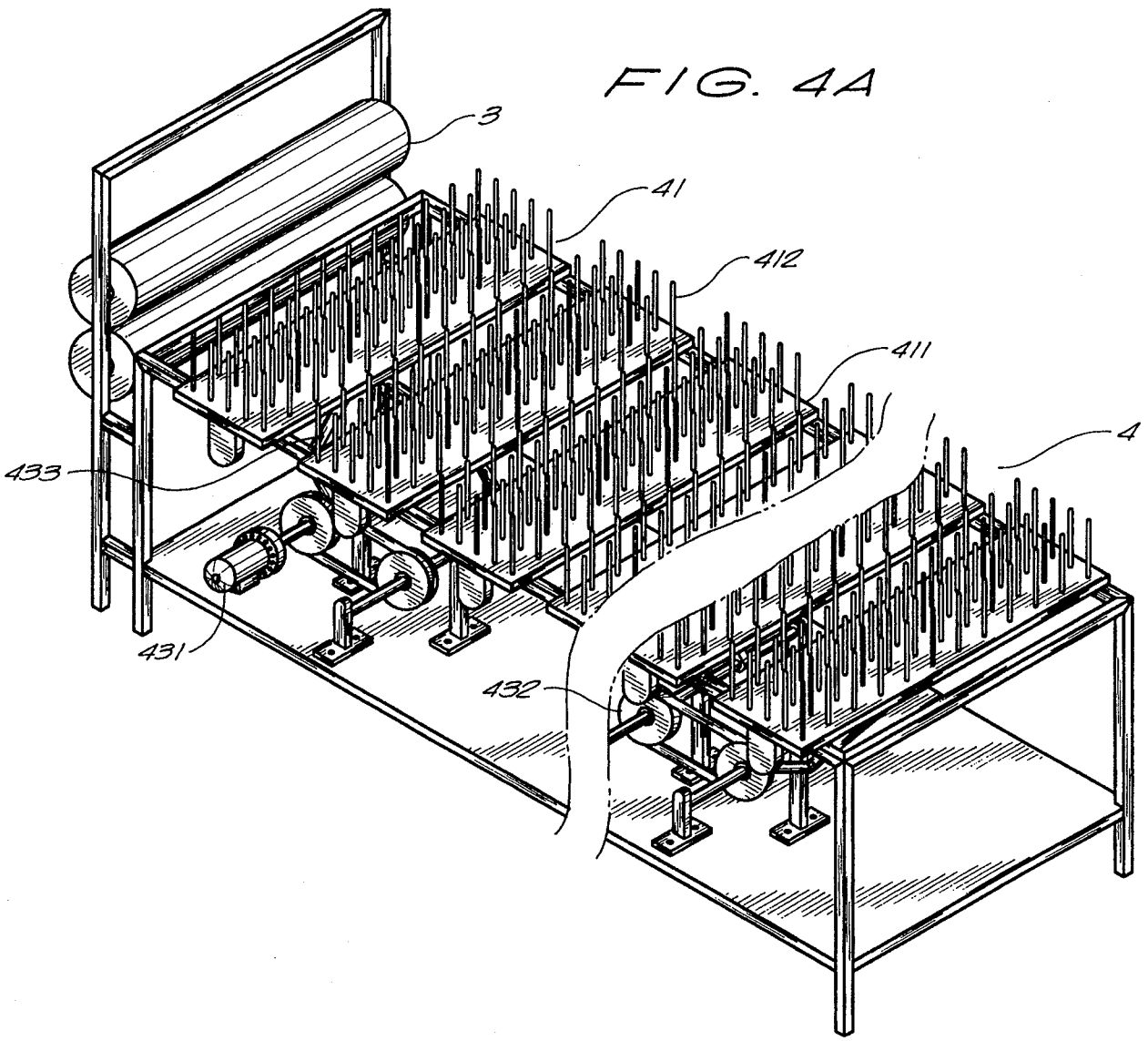
FIGS. 4A and 4B are a perspective views of different embodiments of a hackling device of the rippling and hackling system of the present invention, respectively.
Figure 4B:
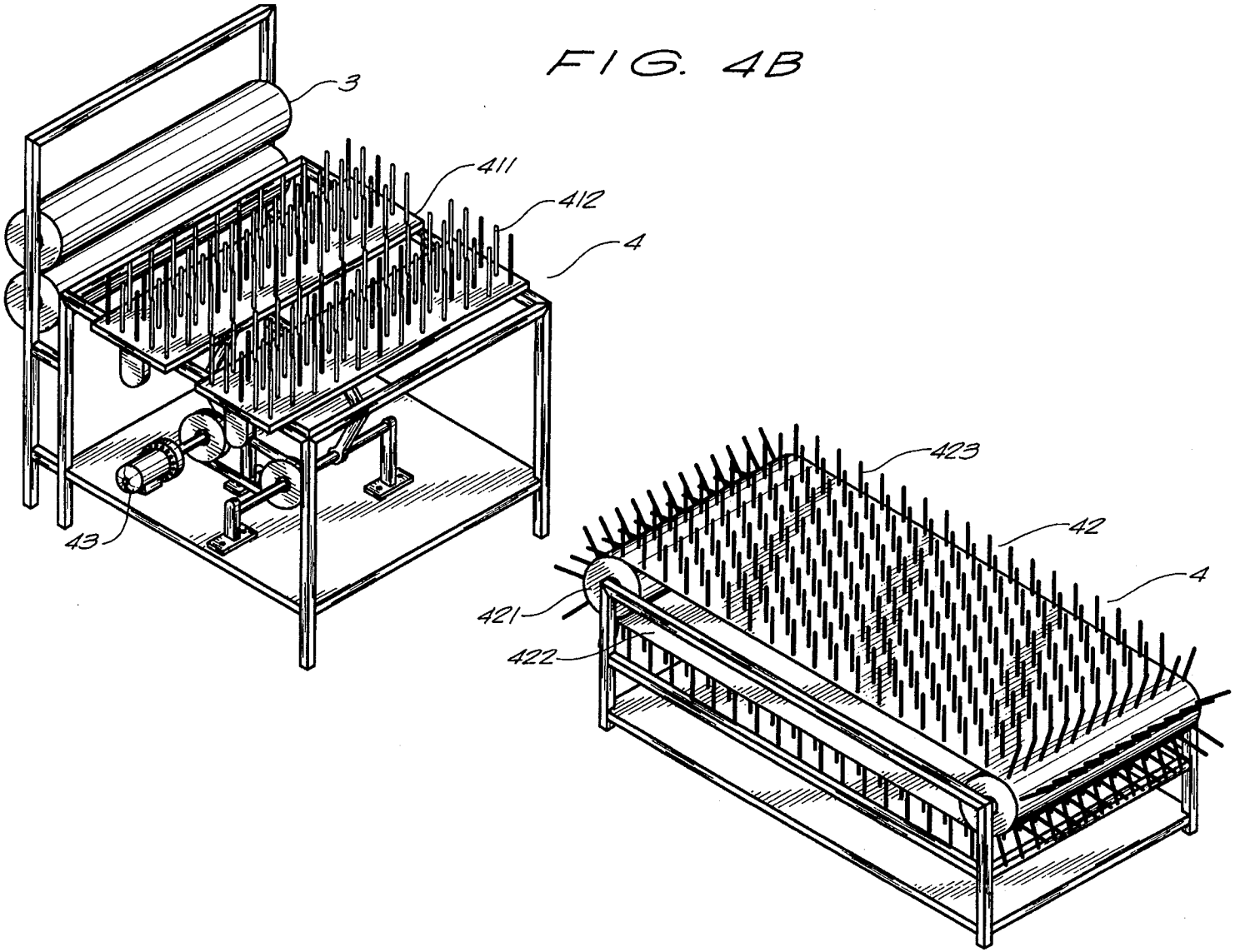

Turning to FIGS. 4A and 4B, there are shown different embodiments of a hackling device 4 of the rippling and hackling system of the present invention, respectively.

As shown is the drawings, the pair of tension rollers 3, preferably rubber rollers, are provided at the front of the hackling device. The embodiment of FIG. 4A comprises a plurality of hackling units each comprising a drive unit 43 and a hackle bar 41. The drive unit 43 includes a drive motor 431, a crank pulley 432 and a crank shaft 433, the crank pulley 432 and the crank shaft 433 transmitting the rotational force of the motor 431 to the hackling bar 41 so that the hackling bar 41 vertically reciprocates. The hackle bar 41 comprises a rectangular plate 411 having a plurality of erect hackle pins 412. Here, it is preferred to provide two to ten hackling units for the hackling device 4, however, the number of the hackle units is not critically limited. In addition, all of the hackle bars 41 may be arranged in an overturned position such that the hackle pins 412 are downwardly oriented.

Turning to the alternative embodiment of the hackling device of FIG. 4B, this embodiment may comprise a plurality of aforementioned hackling units and a plurality of hackle conveyors 42 cooperating with the hackling units in order to hackle the entangled wig yarns. Each of the hackle conveyors 42 comprises a pair of belt pulleys 421 supported by a frame to be spaced apart from each other and an endless hackle belt 422 wrapping about the belt pulleys 421. The hackle belt 422 is provided thereon with a plurality of erect hackle pins 423 and driven in a direction opposite to a feeding direction of the wig yarns to be hackled, so that the entangled wig yarns are arranged neatly while passing above the hackle belt 422 moving in the opposite direction.

In this case, it is preferred to alternately arrange the hackle bar 41 and the hackle conveyor 42.

In still another embodiment of the present invention, the hackling device 4 only comprises the hackling conveyors, however, this embodiment is not shown in the accompanying drawings.

Figure 5:
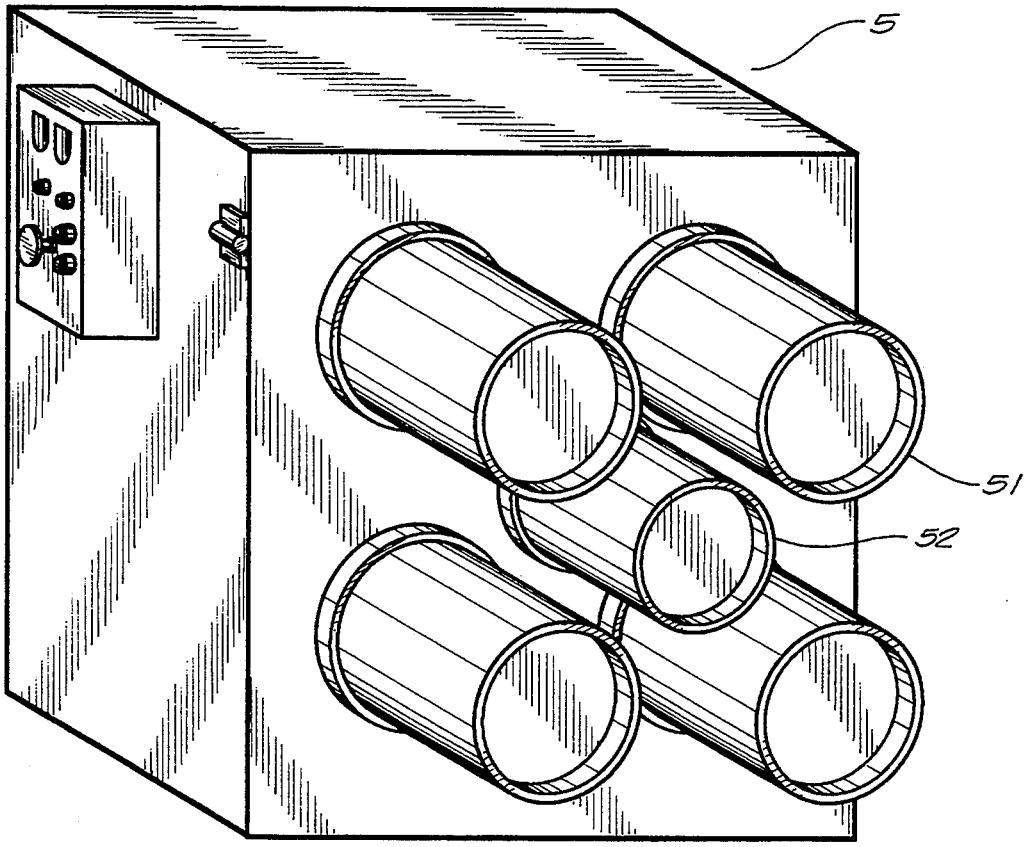
FIG. 5 is a perspective view of a pulling roller device of the rippling and hackling system of the present invention.

Referring to FIG. 5, there is shown a pulling roller device 5 in accordance with an embodiment of the present invention. The pulling roller device 5 comprises a plurality of rollers 51 which are three to fifteen-stepped and have different diameters. The plurality of pulling rollers may be arranged in a vertical zigzag, but they are preferably arranged in the rectangular profile, as shown in FIG. 5, such that four larger diameter rollers 51 are arranged at the corners while a smaller diameter roller 52 is arranged at the center. In such a roller arrangement of rectangular profile, the wig yarns are tightly stretched by the rollers 51 and 52 while zigzag passing by the rollers 51 and 52.

In the operation of the rippling and hackling system of the present invention, the wig yarns to be rippled and hackled are drawn in a bundle or separately from respective bobbins and bitten by the wave rollers 11 of the rippling heater 1 prior to start of the system. When the system is turned on, the wig yarns pass between the upper and lower wave rollers 11 while being jammed by the engaging teeth 12 of the rollers 11 and heated by the heating coil 13, thereby being rippled in a desired shape. The rippled and heated yarns are, thereafter, fed to the cooler 2 and moved by the turning cooling belt 21. At this time, a blast of air is supplied from the pneumatic fans 24 to the pneumatic diffusers 22 through the pneumatic pipes 23 and blown from the diffusers 22 which are arranged above or under the cooling belt 21. Thus, the rippled and heated yarns are air-cooled while moving on the cooling belt 21 and maintain their rippled shape.

Thereafter, the wig yarns are fed to the hackling device 4 by way of the pair of tension rollers 3. Here, there is provided a space causing sag of the wig yarns between the cooler 2 and the tension rollers 3, so that it is possible to compensate a difference in the processing velocity between the rippling heater 1 and the hackling device 4. The wig yarns from the cooler 2 are pulled by the tension rollers 3 in order to be applied to the hackling device 4 wherein the rippled wig yarns are hackled while passing above at least two sets of hackle bars 41. At this time, when the crank pulley 432 of the drive unit 43 is rotated by the drive motor 431, the crank shaft 433 causes the hackle bars 41 to alternately reciprocate upwards and downwards. The alternate upward and downward reciprocation of the hackle bars 41 hackles, in cooperation with the back tensile force of the tension rollers 3 and the pulling force of the pulling roller device 5, the entangled wig yarns passing through the hackle pins 412 on the plate 411 with a predetermined uniform hackling force.

In the case of the second alternate embodiment having the hackle conveyors 42, the hackle conveyor 42 is driven by the belt pulleys 421 in the direction opposite to the feeding direction of the yarns, so that the plurality of erected hackle pins 423 on the hackle belt 421 hackle the wig yarns, thereby loosening the excessively rippled yarns and arranging the entangled yarns neatly.

The wig yarns are, thereafter, zigzag pass by the rollers 51 and 52 of the pulling roller device 5 and the rippling and hackling process is finished.

As described above, the present invention provides an automatic system for rippling and hackling the wig yarns by which the rippling process and the hackling process for the wig yarns are automatically carried out in an integrated process. Thus, the present invention achieves the automation of the rippling and hackling process and scarcely requires human power, and furthermore, provides a good quality of wig yarns.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for automatically rippling and hackling wig yarns comprising:

means for heating and rippling the wig yarns, said means comprising a pair of rollers engaging with each other such that said rollers heat and ripple the wig yarns, each of said rollers having an outer surface and a heating coil heating said outer surface to a temperature of between 80°–200° C., said outer surface having a plurality of rounded teeth extending axially thereacross, the rounded teeth of the outer surface having a pitch of between 1 mm to 30 mm and a tooth height of between 1 mm to 30 mm;

a cooler arranged after said heating and rippling means and comprising a cooling belt and pneumatic means, said pneumatic means for directing cooling air toward said cooling belt, said pneumatic means comprising a fan, a pipe communicating with said fan, and a diffuser connected to said pipe distal said fan;

means for hackling the wig yarns positioned after said cooler, said means for hackling comprising a plurality of hackling units, each of said hackling units including a hackle bar and drive means for driving said hackling bar, said hackle bar having a plate provided with a plurality of erect hackle pins and vertically reciprocating by a rotational force of said drive means, and said drive means comprising a motor and a power transmission gear transmitting the rotational force of said motor to said hackle bars;

a pair of tension rollers arranged between said cooler and said hackling means, said tension rollers receiving the wig yarns therebetween; and means for pulling said wig yarns from said hackling means, said means for pulling comprising a plurality of pulling rollers, at least one of said plurality of pulling rollers having a different diameter than another of said plurality of pulling rollers.

2. A system for automatically rippling and hackling wig yarns while the yarns are fed in one direction therethrough comprising:

means for heating and rippling the wig yarns, said means comprising a pair of rollers engaging with each other such that said wave rollers heat and ripple the wig yarns, each of said rollers having an outer surface and a heating coil means for heating said outer surface to a temperature of between 80°–200° C., said outer surface having a plurality of rounded teeth extending axially thereacross, the rounded teeth of the roller surface having a pitch of between 1 mm to 30 mm and a tooth height of between 1 mm to 30 mm;

a cooler arranged after said heating and rippling means and comprising a cooling belt and pneumatic means, said pneumatic means for directing cooling air toward said cooling belt, said pneumatic means comprising a fan, a pipe communicating with said fan, and a diffuser connected to said pipe distal said fan, said diffuser directed toward said cooling belt;

means for hackling the wig yarns positioned after said cooler, said means for hackling comprising a plurality of hackling conveyors, each of said hackling conveyors including a pair of belt pulleys and an endless hackle belt wrapping about said belt pulleys, said hackle belt having a plurality of erect hackle pins extending outwardly therefrom, said hackle belt moving in a direction opposite to the feeding direction of the wig yarns;

a pair of tension rollers arranged between said cooler and said hackling means, said tension rollers receiving the wig yarns therebetween; and means for pulling said wig yarns from said hackling means, said pulling means comprising a plurality of pulling rollers, at least one of said plurality of pulling rollers having a different diameter than another of said plurality of pulling rollers.

3. A system for automatically rippling and hackling wig yarns comprising:

means for heating and rippling the wig yarns as the wig yarns are fed therethrough in one direction, said means comprising a pair of rollers engaging with each other such that said rollers heat and ripple the wig yarns, each of said rollers having an outer surface and a heating coil means for heating said outer surface to a temperature of between 80°–200° C., said outer surface having a plurality of rounded teeth extending axially thereacross, the rounded teeth of the outer surface having a pitch of between 1 mm to 30 mm and a tooth height of between 1 mm to 30 mm;

a cooler arranged after said heating and rippling means and comprising a cooling belt and pneumatic means, said pneumatic means for directing cooling air toward the wig yarns on said cooling belt, said pneumatic means comprising a fan, a pipe communicating with said fan, and a diffuser connected to said pipe distal said fan, said diffuser directed toward the wig yarns;

means for hackling the wig yarns positioned after said cooler, said means for hackling comprising:

a plurality of hackling units, each including a hackling bar and drive means for driving said hackling bar, said hackle bar having a plate provided with a plurality of erect hackle pins extending outwardly therefrom, said hackle bar vertically reciprocating by a rotational force of said drive means, said drive means comprising a motor and a power transmission gear for transmitting the rotational force of said motor to said hackle bar; and a plurality of hackling conveyors, each of said hackling conveyors having a pair of belt pulleys and an endless hackle belt wrapping about said belt pulleys, said hackle belt having a plurality of erect hackle pins extending outwardly therefrom, said hackle belt moving in a direction opposite to the feed direction of the wig yarns;

a pair of tension rollers arranged between said cooler and said hackling means, said tension rollers receiving the wig yarns therebetween; and means for pulling said wig yarns from said hackling means, said pulling means comprising a plurality of pulling rollers, at least one of said plurality of pulling rollers having a different diameter than another of said plurality of pulling rollers.

4. A system for automatically rippling and hackling wig yarns according to claim 3, wherein said hackling means comprises at least two hackling units and at least two hackling conveyors such that the sum of said hackling units and said hackling conveyors is seven.

* * * * *